United States Patent [19]

Denzer et al.

[11] Patent Number: 5,061,327

[45] **Date of Patent: * Oct. 29, 1991**

[54] METHOD OF PRODUCING UNRECRYSTALLIZED ALUMINUM PRODUCTS BY HEAT TREATING AND FURTHER WORKING

[75] Inventors: Diana K. Denzer; John Liu, both of Lower Burrell, Pa.

[73] Assignee: Aluminum Company of America, Pittsburgh, Pa.

[ * ] Notice: The portion of the term of this patent subsequent to Jan. 29, 2008 has been disclaimed.

[21] Appl. No.: 502,822

[22] Filed: Apr. 2, 1990

[51] Int. Cl.[5] ..... C22F 1/04

[52] U.S. Cl. ..... 148/12.7 A; 148/11.5 A; 148/159; 148/417; 148/439

[58] Field of Search ..... 148/11.5 A, 12.7 A, 148/159, 417, 439

[56] References Cited

U.S. PATENT DOCUMENTS

| | | | |
|---|---|---|---|
| 4,305,763 | 12/1981 | Quist et al. | 148/12.7 A |
| 4,336,075 | 6/1982 | Quist et al. | 148/12.7 A |
| 4,528,042 | 7/1985 | Ward et al. | 148/11.5 A |
| 4,795,502 | 1/1989 | Cho | 148/12.7 A |
| 4,844,750 | 7/1989 | Cho et al. | 148/12.7 A |
| 4,915,747 | 4/1990 | Cho | 148/12.7 A |
| 4,921,548 | 5/1990 | Cho | 148/12.7 A |
| 4,927,470 | 5/1990 | Cho | 148/12.7 A |

*Primary Examiner*—H. Dean
*Assistant Examiner*—Robert R. Koehler
*Attorney, Agent, or Firm*—Andrew Alexander

[57] ABSTRACT

Disclosed is a method of producing an unrecrystallized aluminum alloy flat rolled product, e.g., plate or sheet, having improved levels of strength and fracture toughness. The method comprises the steps of providing a body of an aluminum base alloy, heating and hot working the body to a first product. This is followed by reheating, cooling and heat treating the first product prior to further working it to an unrecrystallized plate or sheet product, for example.

49 Claims, 1 Drawing Sheet

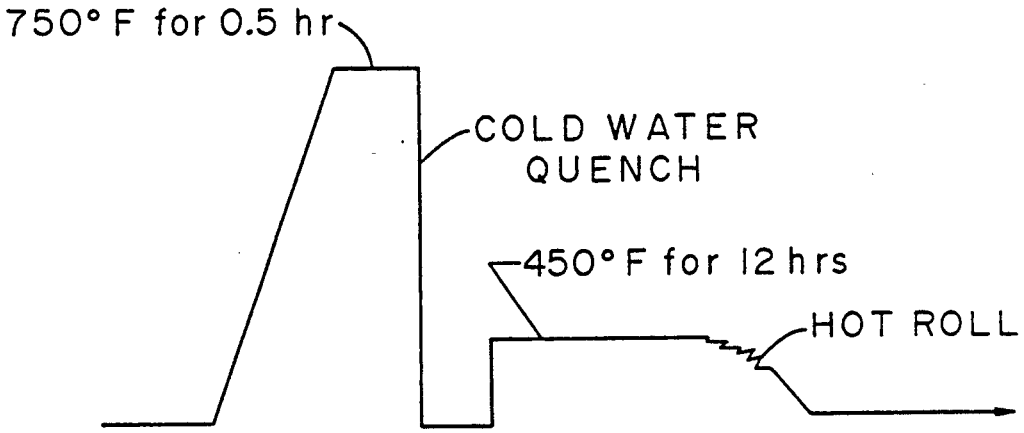
750° F for 0.5 hr
COLD WATER QUENCH
450° F for 12 hrs
HOT ROLL

METHOD OF PRODUCING UNRECRYSTALLIZED ALUMINUM PRODUCTS BY HEAT TREATING AND FURTHER WORKING

INTRODUCTION

This invention relates to heat treatable alloys such as the AA2000, 6000 and 7000 series alloys and more specifically, it relates to thermal mechanical processing of such alloys to improve strength and fracture toughness in thin plate, for example.

For many years, alloys of the 7000 series have been used for high strength and toughness in aerospace applications. These alloys can be age hardened to very high strengths, for example, in the T6 temper condition. Further, the strengths of these alloys may be increased by increasing solute content. Increasing the strength of these alloys permits designers to reduce the weight of aircraft by reducing thickness of load carrying components such as upper wing skins. Such components must have (and even demand) relatively high fracture toughness as well as high strength to be useful. Several sources indicate that plate having an unrecrystallized structure develops higher toughness than plate having a recrystallized structure. It is well known by those skilled in the art that maintaining the rolling temperature at a high level, typically above about 750° F., allows the aluminum alloy to dynamically recover with a fine subgrain structure, typically about 1 to 2 μm. This dynamically recovered structure is resistant to recrystallization during subsequent solution heat treatment. However, while increased strength and toughness allows the use of thinner gauges, prior fabricating techniques and thermal mechanical practices often do not permit production of such products with an unrecrystallized structure because of the tendency for the rolling temperature to fall as the plate thickness is reduced.

Prior art teaches how to achieve recrystallized grain structure but not how to achieve unrecrystallized structure. In the prior art, U.S. Pat. No. 4,092,181 discloses a method of imparting a fine grain recrystallized structure to aluminum alloys having precipitating constituents. The method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy but below its solution treating temperature. Strain energy is introduced into the alloy by plastically deforming it at or below the overaging temperature used. The alloy is then subsequently held at a recrystallization temperature so that the new grains are nucleated by the overaged precipitates and the development of these grains results in a fine recrystallized grain structure. This structure is useful for imparting superplastic properties but will provide lower toughness than an unrecrystallized structure.

In contrast, the present invention provides improved thermal mechanical processing techniques which permit the fabrication of flat rolled products, particularly thin gauge plate and sheet fabricated from aluminum alloys having a substantially unrecrystallized structure which imparts to the plate improved combinations of strength and fracture toughness.

SUMMARY OF THE INVENTION

A principal object of this invention is to provide an improved aluminum based, heat treatable, flat rolled product.

Another object of this invention is to provide an unrecrystallized, 7000 series alloy, thin gauge plate or sheet product.

Yet another object of this invention is to provide a process for making an unrecrystallized, 7000 series alloy, thin gauge flat rolled product.

These and other objects will become apparent from the specification, drawings and claims appended hereto.

In accordance with these objects, there is provided an unrecrystallized thin gauge flat rolled product suitable for fabricating into aircraft structural members, the unrecrystallized thin gauge flat rolled product comprised of aluminum base alloys selected from AA 2000, 6000 and 7000 series alloys.

Also, there is provided a method of producing an unrecrystallized aluminum alloy, thin gauge flat rolled product which includes hot working a body of the alloy to a first product. The first product is then reheated, cooled and heat treated before rolling to a thin gauge flat rolled product, e.g., thin gauge plate or sheet. This is followed by solution heat treating, quenching and aging to provide a substantially unrecrystallized product having improved levels of strength and fracture toughness.

BRIEF DESCRIPTION OF THE DRAWING

The sole FIGURE is a schematic representing steps in the process for producing thin gauge unrecrystallized plate in accordance with the invention.

DETAILED DESCRIPTION OF THE PREFERRED EMBODIMENTS

Aluminum based alloys which respond to thermal mechanical processing in accordance with the present invention include the Aluminum Association 7000 series. Such alloys include, for example, 7050, 7150, 7075, 7475, 7049 and 7039.

Typically, these aluminum based alloys contain 1.0 to 12.0 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc and Hf, the balance aluminum, incidental elements and impurities. These alloys may be referred to as Al—Z—Mg or Al—Zn—Cu—Mg type. Alloys which seem to respond more readily to thermal mechanical processing in accordance with the present invention include higher levels of zinc, preferably 7.0 to 12.0 wt. % Zn with a typical level being 8.0 to 11.0 wt. %. Magnesium at these levels of zinc can range from 0.2 to 3.5, preferably 0.4 to 3.0 wt. %. Also, copper at the higher zinc levels can range from 0.5 to 3.0 wt. %, preferably 1.0 to 3.0 wt. %. These alloying elements may be higher in certain cases, but the resulting alloys can have low fracture toughness. In certain cases, other ranges of alloying elements may be preferred. For example, Zn can be in the range of 7.0 to 9.0 wt. %, Mg 1.5 to 2.5 wt. %, Cu 1.9 to 2.7 wt. %, Zr 0.08 to 0.14 wt. %, with impurities such as Fe and Si being less than 0.3 wt. %. The Aluminum Association composition limits encompassing 7050 and 7150 are: 5.7 to 6.9 wt. % Zn, 1.9 to 2.7 wt. % Mg, 1.9 to 2.6 wt. % Cu, 0.05 to 0.15 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and incidental elements and impurities.

While the AA7000 series aluminum alloys have been described in detail, it will be understood that the invention can be applied to other heat treatable alloys such as the AA2000 and 6000 series aluminum alloys as well as AA8000 alloys which include lithium, e.g. 8090 and 8091. Thus, typical AA2000 series alloys which may be included are 2024, 2124, 2324, 2219, 2519, 2014, 2618, 2034, 2090 and 2091, and typical of AA6000 series alloys are 6061 and 6013. Products formed from these alloys have oxygen content of less than 0.1 wt. %. Further, the products, e.g., flat rolled products, are substantially free of the as-cast structure.

As well as providing the alloy product with controlled amounts of alloying elements as described herein, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. The ingot or billet may be preliminarily worked or shaped to provide suitable stock for subsequent working operations. Prior to the principal working operation, the alloy stock is preferably subjected to homogenization, and preferably at metal temperatures in the range of 850° to 1050° F. for a period of time of at least one hour to dissolve soluble elements and to homogenize the internal structure of the metal. A preferred time period is about 20 hours or more in the homogenization temperature range. Normally, the heat up and homogenization treatment does not have to extend for more than 40 hours; however, longer times are not normally detrimental. A time of 20 to 40 hours at the homogenization temperature has been found quite suitable.

To produce an unrecrystallized thin gauge plate or sheet product, the thermomechanical steps must be carefully controlled. By unrecrystallized is meant the absence of well-developed grains and the presence of a highly worked structure containing recovered subgrain and retaining as-worked crystallographic texture, i.e., at least 60% of the plate or sheet is free of well-developed grains or retains the as-worked texture. Thus, after homogenization of the ingot and hot rolling to a slab dimension, the slab is reheated typically to a temperature in the range of 500° to 900° F. or higher and preferably 650° or 700° to 800° F. or higher (depending upon composition), for purposes of dissolving or partially dissolving particles that precipitated during the preceding thermal mechanical operation. Reheating can be carried out in a time as short as ¼, or ½ hour at temperature, and can extend for 4 hours or more. However, the longer times are not normally necessary. For alloys in the 2000, 6000 and 7000 series, for example, reheating may be to temperatures greater than 900° F.. That is, reheating may be carried out to temperatures above the solvus temperature of the strengthening elements, e.g., Zn, Mg, Cu in 7000 type alloys. Thus, the reheating temperature can range from 900° F. or above to 1080° F. for some alloys. Typically, the reheating temperature can range from 910° F. to 1060° F. Aluminum-lithium alloys can require a reheat in the temperature range of 950° to 1040° F. Also, some 7000 series alloys, e.g., 7×75, can require a reheat temperature of from above 900° F. to 1010° F., for example. After reheating, the slab is cooled at a rate sufficient to retain dissolved elements in solution. Preferably, the slab is cold water quenched or rapidly cooled. Thereafter, the slab is subjected to an elevated temperature precipitation heat treatment to precipitate particles in a controlled manner. The precipitation heat treatment can be carried out at a temperature in the range of 200° to 550° F., preferably 350° to 500° F., with typical temperatures being 400 to 500° F. Precipitation heat treatment times at this temperature can range from 5 to 20 hours or longer, and times of from 9 to 15 hours can be quite suitable. After the precipitation heat treatment, the slab is worked or rolled to thin gauge plate or to sheet stock. Thin gauge plate contemplates having a thickness of at least 0.125, typically 0.25 inch or more. The thickness can extend to 0.5 inch or more, for example, 0.75 or 1.0 or even 1.25 inch.

While the slab may be cold rolled, it is preferred that the slab be rolled to final gauge, e.g., thin gauge plate or sheet, using warm rolling practices. Thus, preferably, warm rolling is performed at a temperature of not greater than 550° F. Further, preferably, the temperature at which warm rolling begins is not less than 200° F. Typically, the warm rolling can begin at the precipitation heat treatment temperature. Preferably, the warm rolling temperature should not exceed the precipitation heat treatment temperature. Such temperatures may be in the range of about 350° to 500° F.; however, rolling may be performed down to room temperature, particularly when high reheating temperatures are used. This warm rolling practice contrasts with the prior art which teaches that rolling temperatures should be significantly higher, typically above about 750° F.

Thereafter, the plate or sheet product can be subjected to solution heat treatment, quenching and aging.

The solution heat treatment is preferably accomplished at a temperature in the range of 800° to 1050° F. and unrecrystallized grain structure is produced. Generally, for sheet gauge, typically times at these temperatures can be relatively short, for example, 5 minutes or even less is adequate. For thin gauge plate, e.g., 0.5 inch, the time required may be as much as 2 hours.

To further provide for the desired strength and fracture toughness necessary to the final product and to the operations in forming that product, the product should be rapidly quenched to prevent or minimize uncontrolled precipitation of strengthening phases. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled.

After the alloy product of the present invention has been quenched, it may be subjected to a subsequent aging operation to provide the combination of fracture toughness and strength which are so highly desired in aircraft members. Artificial aging can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 100 ksi. However, the useful strengths are in the range of 70 to 90 ksi and corresponding fracture toughnesses are in the range of 20 to 50 ksi/in. Preferably, artificial aging is accomplished by subjecting the alloy product to a temperature in the range of 275° to 375° F. for a period of at least 30 minutes. A suitable aging practice contemplates a treatment of about 8 to 24 hours at a temperature of about 325° F. Further, it will be noted that the alloy product in accordance with the present invention may be subjected to any of the typical overaging or underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

While the invention has been described with respect to sheet and plate, it will be appreciated that its application is not necessarily limited thereto. That is, the process can be applied to extrusions and forgings having alloy compositions referred to herein or responsive to these treatments. In contrast to rolling, for extrusion purposes, it is not difficult to keep the ingot hot, but it is uneconomical to do so because of the slow extruding rates. Consequently, extrusions typically have a recrystallized structure. To provide an unrecrystallized extrusion in accordance with the invention, the process would include two or more extruding steps. That is, after achieving an ingot temperature of about 700° to 800°, the ingot is extruded to an intermediate cross-sectional area, e.g., to reduce the area 75%. Thereafter, the partially extruded material is subjected to a reheating step, for example, under the same conditions as referred to herein with respect to slab. Also, it is cooled and subjected to an elevated precipitation treatment as referred to for slab, for example. Thereafter, the partial extrusion is further worked or extruded to product form preferably utilizing warm temperatures, for example, under the same conditions referred to for slab being rolled to final gauge. Thereafter, the extrusion may be solution heat treated, quenched and aged to produce an unrecrystallized aluminum alloy extrusion. Because forgings are formed often repeating the same working operation, the forging operation may be carried out incorporating the procedures set forth for the flat rolled product to produce an unrecrystallized aluminum alloy forged product. It will be appreciated that the rolling, extruding or forging steps may be combined to produce an unrecrystallized product.

An aluminum alloy having a nominal weight percent of 10 Zn, 1.8 Mg, 1.5 Cu and 0.12 Zr, the balance essentially aluminum and impurities, was cast into an ingot suitable for rolling. The ingot was homogenized and then hot rolled at about 800° F. to a 1.5 inch thick slab. Thereafter, the slab was annealed for 30 minutes at 750° F. and cold water quenched. The slab was then precipitation heat treated for 12 hours at 400° F. Thereafter, the slab was rolled at about 400° F. to 0.3 inch thick plate and then solution heat treated at 880° F. for 1 hour and cold water quenched. Examination revealed that the microstructure was substantially an unrecrystallized microstructure. By comparison, identical samples which were not aged, but hot rolled to 0.3 inch plate immediately after annealing at 750° F. showed a high degree of recrystallization. Thus, it will be seen that thermomechanical processing in accordance with the subject invention can produce an unrecrystallized thin gauge plate or sheet product in the Al—Zn—Mg or Al—Zn—Mg—Cu type aluminum alloys.

Having thus described the invention, what is claimed is:

1. A method of producing an unrecrystallized, wrought aluminum base alloy, heat treated product having improved levels of strength and fracture toughness, the method comprising the steps of:

(a) providing a body of an aluminum base, heat treatable alloy;
(b) hot working the body to a first wrought product;
(c) reheating said first wrought product from above 900° to 1080° F.;
(d) cooling said first wrought product;
(e) heat treating said first wrought product;
(f) further working said first wrought product to produce a second wrought product; and
(g) solution heat treating, quenching and aging said second wrought product to provide a substantially unrecrystallized product having improved levels of strength and fracture toughness.

2. The method in accordance with claim 1 wherein the reheating is performed in the range of 910° to 1060° F.

3. The method in accordance with claim 1 wherein the reheating is performed in the range of 960° to 1040° F.

4. The method in accordance with claim 1 wherein the reheating is performed in the range of from above 900° to 1010° F.

5. The method in accordance with claim 1 wherein said working of said first product is rolling to a gauge of at least 0.125 inch thick.

6. The method in accordance with claim 1 wherein said working of said first product is rolling to a gauge in the range of 0.25 to 1.0 inch thick.

7. The method in accordance with claim 1 wherein said working of said first product is rolling to a gauge in the range of 0.25 to 0.5 inch thick.

8. The method in accordance with claim 1 wherein the alloy is selected from Aluminum Association alloys 7075 and 7475.

9. The method in accordance with claim 1 wherein the alloy is selected from 2000, 6000 and 7000 type aluminum alloys.

10. The method in accordance with claim 9 wherein the alloy is selected from 2000 type aluminum alloys.

11. The method in accordance with claim 9 wherein the alloy is selected from 6000 type aluminum alloys.

12. The method in accordance with claim 10 wherein the alloy is selected from Aluminum Association alloys 2024, 2124, 2324, 2219, 2519, 2014 and 2618.

13. The method in accordance with claim 11 wherein the alloy is Aluminum Association alloy 6013.

14. The method in accordance with claim 1 wherein the first wrought product is an extrusion.

15. The method in accordance with claim 1 wherein the second wrought product is an extrusion.

16. The method in accordance with claim 1 wherein the alloy is selected from 8090 and 8091.

17. The method in accordance with claim 1 wherein the first wrought product is a forged product.

18. The method in accordance with claim 1 wherein the second wrought product is a forged product.

19. A method of producing an unrecrystallized aluminum alloy flat rolled product having improved levels of strength and fracture toughness, the method comprising the steps of:

(a) providing a body of an AA 2000 series alloy;
(b) heating the body to a hot working temperature;

(c) hot rolling the body to a first plate product;
(d) reheating said first product in a temperature range of about 910° to 1060° F. for at least ¼ hour;
(e) rapidly cooling said first product after said reheating;
(f) precipitation heat treating said first wrought product at a temperature in the range of 350° to 500° F. for a period of 5 to 20 hours;
(g) warm rolling said first wrought product, the warm rolling starting at a temperature in the range of 200° to 550° F.; and
(h) solution heat treating, quenching and aging said product after warm rolling to provide a substantially unrecrystallized product having improved levels of strength and fracture toughness.

20. The method in accordance with claim 19 wherein the product after warm rolling has a thickness in the range of 0.125 to 0.75 inch.

21. The method in accordance with claim 19 wherein the product after warm rolling has a thickness in the range of 0.25 to 0.5 inch.

22. The method in accordance with claim 19 wherein the alloy is selected from Aluminum Association alloys 2024, 2124, 2324, 2219, 2519, 2014 and 2618.

23. A method of producing an unrecrystallized aluminum alloy flat rolled product having improved levels of strength and fracture toughness, the method comprising the steps of:
(a) providing a body of an AA 6000 series alloy;
(b) heating the body to a hot working temperature;
(c) hot rolling the body to a first plate product;
(d) reheating said first product in a temperature range of 910° to 1050° F. for at least ¼ hour;
(e) rapidly cooling said first product after said reheating;
(f) precipitation heat treating said first wrought product in the range of 350° to 500° F. for a period of 5 to 20 hours;
(g) warm rolling said first wrought product, the warm rolling starting at a temperature in the range of 200° to 550° F.; and
(h) solution heat treating, quenching and aging said product after warm rolling to provide a substantially unrecrystallized product having improved levels of strength and fracture toughness.

24. The method in accordance with claim 23 wherein the alloy is Aluminum Association alloy 6013.

25. The method in accordance with claim 23 wherein the product has a thickness in the range of 0.125 to 0.75 inch.

26. The method in accordance with claim 23 wherein the product after warm rolling has a thickness in the range of 0.25 to 0.5 inch.

27. A method of producing an unrecrystallized aluminum alloy flat rolled product having improved levels of strength and fracture toughness, the method comprising the steps of:
(a) providing a body of an AA 7×75 series alloy;
(b) heating the body to a hot working temperature;
(c) hot rolling the body to a first plate product;
(d) reheating said first product in a temperature range of from above 900° to 1000° F. for at least ¼ hour;
(e) rapidly cooling said first product after said reheating;
(f) precipitation heat treating said first wrought product in the range of 350° to 500° F. for a period of 5 to 20 hours;
(g) warm rolling said first wrought product, the warm rolling starting at a temperature in the range of 200° to 550° F.; and
(h) solution heat treating, quenching and aging said product after warm rolling to provide a substantially unrecrystallized product having improved levels of strength and fracture toughness.

28. The method in accordance with claim 23 wherein the final gauge product has a thickness in the range of 0.125 to 0.75 inch.

29. The method in accordance with claim 23 wherein the final gauge product has a thickness in the range of 0.25 to 0.5 inch.

30. The method in accordance with claim 19 wherein the warm rolling starts at a temperature in the range of 350° to 500° F.

31. The method in accordance with claim 27 wherein the alloy is 7075.

32. The method in accordance with claim 27 wherein the alloy is 7175.

33. A method of producing an unrecrystallized lithium-containing aluminum base alloy structural member having improved levels of strength and fracture toughness, the method comprising the steps of:
(a) providing a body of a lithium-containing aluminum base alloy;
(b) heating the body to a hot working temperature;
(c) hot working the body to a first product;
(d) annealing said first wrought product in a temperature range of 950° to 1040° F.;
(e) cooling said first wrought product;
(f) aging said first wrought product;
(g) further working said first wrought product to a flat rolled product;
(h) solution heat treating, quenching and aging said product to provide a substantially unrecrystallized product having improved levels of strength and fracture toughness; and
(i) forming said unrecrystallized flat rolled product into said structural member.

34. The method in accordance with claim 33 wherein said further working is rolling said first product to thin gauge product having a thickness in the range of about 0.125 to 1.5 inch.

35. The method in accordance with claim 33 wherein said second wrought product is thin gauge plate having a thickness in the range of about 0.25 to 1.25 inch.

36. The method in accordance with claim 35 wherein said second wrought product is thin gauge plate having a thickness in the range of about 0.25 to 1.0 inch.

37. The method in accordance with claim 35 wherein said second wrought product is thin gauge plate having a thickness in the range of about 0.25 to 0.75 inch.

38. The method in accordance with claim 35 wherein said second wrought product is thin gauge plate having a thickness in the range of about 0.25 to 0.50 inch.

39. The method in accordance with claim 33 wherein the further working is warm rolling starting in the range of 200° to 500° F.

40. A method of producing an unrecrystallized lithium-containing aluminum aircraft structural member having improved levels of strength and fracture toughness, the method comprising the steps of:
(a) providing a body of a lithium-containing aluminum alloy;
(b) heating the body to a hot working temperature;
(c) hot rolling the body to a first plate product;

(d) reheating said first product in the range of 950° to 1040° F. for at least 0.25 hours;
(e) cold water quenching said first product after said annealing;
(f) precipitation heat treating said first plate product in the range of 350° to 500° F. for a period of 5 to 20 hours;
(g) warm rolling said first plate product to a flat rolled product having a thickness in the range of about 0.125 to 0.75 inches, the warm rolling starting at a temperature in the range of 200° to 500° F.;
(h) solution heat treating, quenching and aging said product after warm rolling to provide a substantially unrecrystallized product having improved levels of strength and fracture toughness; and
(i) forming said unrecrystallized product into said aircraft structural member.

41. In a method of producing an unrecrystallized wrought product, the improvement wherein said product is provided as an aluminum alloy, said unrecrystallized product being provided in the condition resulting from:
(a) bringing a body of the alloy to a hot working temperature;
(b) hot working the body to a first product;
(c) reheating said first wrought product in the range of from above 900° to 1080° F.;
(d) cooling said first wrought product;
(e) heat treating said first wrought product;
(f) working said first wrought product to a second wrought product; and
(g) solution heat treating, quenching and aging said second wrought product to provide a substantially unrecrystallized product having improved levels of strength and fracture toughness.

42. The method in accordance with claim 41 wherein the alloy is selected from 2000, 6000 and 7000 type aluminum alloys.

43. The method in accordance with claim 41 wherein the alloy is 7175.

44. The method in accordance with claim 41 wherein the alloy is 7×75.

45. The method in accordance with claim 41 wherein the alloy is selected from 2000 type aluminum alloys.

46. The method in accordance with claim 41 wherein the alloy is selected from 6000 type aluminum alloys.

47. The method in accordance with claim 41 wherein the alloy is selected from Aluminum Association alloys 2024, 2124, 2324, 2219, 2519, 2014 and 2618.

48. The method in accordance with claim 41 wherein the alloy is Aluminum Association alloy 6013.

49. The method in accordance with claim 41 wherein the alloy is selected from 8090 and 8091.

* * * * *

UNITED STATES PATENT AND TRADEMARK OFFICE

CERTIFICATE OF CORRECTION

PATENT NO. : 5,061,327

DATED : October 29, 1991

INVENTOR(S) : Diana K. Denzer et al

It is certified that error appears in the above-identified patent and that said Letters Patent is hereby corrected as shown below:

The title page, showing the illustrative figure, and the drawing sheet, should be deleted and substitute therefor the attached title page and drawing sheet.

United States Patent [19]

Denzer et al.

[11] Patent Number: 5,061,327

[45] Date of Patent: * Oct. 29, 1991

[54] METHOD OF PRODUCING UNRECRYSTALLIZED ALUMINUM PRODUCTS BY HEAT TREATING AND FURTHER WORKING

[75] Inventors: Diana K. Denzer; John Liu, both of Lower Burrell, Pa.

[73] Assignee: Aluminum Company of America, Pittsburgh, Pa.

[ * ] Notice: The portion of the term of this patent subsequent to Jan. 29, 2008 has been disclaimed.

[21] Appl. No.: 502,822

[22] Filed: Apr. 2, 1990

[51] Int. Cl.[5] ..... C22F 1/04

[52] U.S. Cl. ..... 148/12.7 A; 148/11.5 A; 148/159; 148/417; 148/439

[58] Field of Search ..... 148/11.5 A, 12.7 A, 148/159, 417, 439

[56] References Cited

U.S. PATENT DOCUMENTS

| | | | |
|---|---|---|---|
| 4,305,763 | 12/1981 | Quist et al. | 148/12.7 A |
| 4,336,075 | 6/1982 | Quist et al. | 148/12.7 A |
| 4,528,042 | 7/1985 | Ward et al. | 148/11.5 A |
| 4,795,502 | 1/1989 | Cho | 148/12.7 A |
| 4,844,750 | 7/1989 | Cho et al. | 148/12.7 A |
| 4,915,747 | 4/1990 | Cho | 148/12.7 A |
| 4,921,548 | 5/1990 | Cho | 148/12.7 A |
| 4,927,470 | 5/1990 | Cho | 148/12.7 A |

*Primary Examiner*—H. Dean
*Assistant Examiner*—Robert R. Koehler
*Attorney, Agent, or Firm*—Andrew Alexander

[57] ABSTRACT

Disclosed is a method of producing an unrecrystallized aluminum alloy flat rolled product, e.g., plate or sheet, having improved levels of strength and fracture toughness. The method comprises the steps of providing a body of an aluminum base alloy, heating and hot working the body to a first product. This is followed by reheating, cooling and heat treating the first product prior to further working it to an unrecrystallized plate or sheet product, for example.

49 Claims, 1 Drawing Sheet

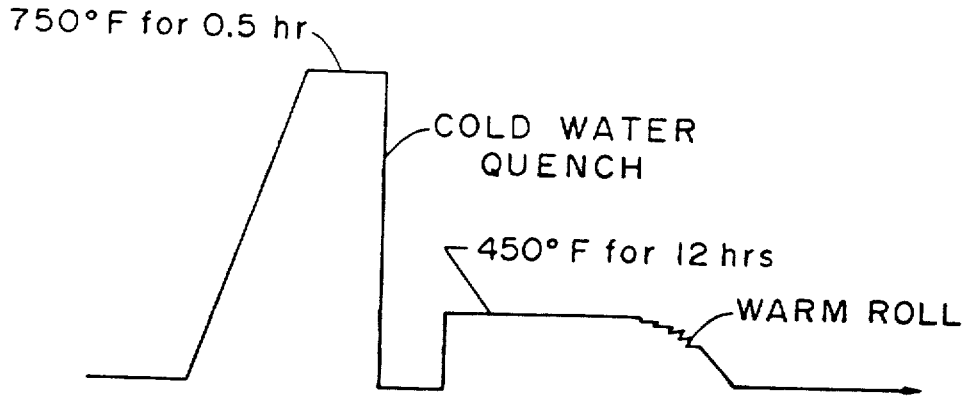

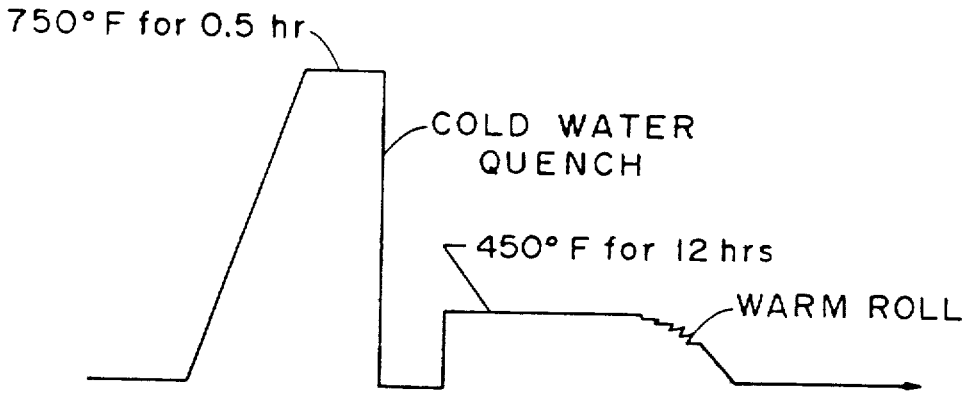
750° F for 0.5 hr
COLD WATER QUENCH
450° F for 12 hrs
WARM ROLL

UNITED STATES PATENT AND TRADEMARK OFFICE

CERTIFICATE OF CORRECTION

PATENT NO. : 5,061,327

DATED : October 29, 1991

INVENTOR(S) : Diana K. Denzer et al

It is certified that error appears in the above-identified patent and that said Letters Patent is hereby corrected as shown below:

| | |
|---|---|
| Col. 4, line 67 | Change "ksi/in" to --ksi in--. |
| Claim 25, Col. 7, line 50 | Insert after "product" --after warm rolling--. |

Signed and Sealed this

Twentieth Day of April, 1993

*Attest:*

*Attesting Officer*

MICHAEL K. KIRK

*Acting Commissioner of Patents and Trademarks*